US005707108A

United States Patent [19]

Pi

[11] Patent Number: 5,707,108

[45] Date of Patent: Jan. 13, 1998

[54] CUSHIONING DEVICE

[76] Inventor: Ching-Tien Pi, 3F, No. 36, Lane 105, Sec.1, Pei Yi Rd., Hsin Tien City, Taipei Hsien, Taiwan

[21] Appl. No.: 759,516

[22] Filed: Dec. 4, 1996

[51] Int. Cl.[6] ..... A47C 7/02

[52] U.S. Cl. ..... 297/230.14; 297/440.24; 297/217.4; 297/184.1; 297/423.39; 297/391

[58] Field of Search ..... 297/230.14, 230.12, 297/230.11, 230.1, 217.4, 180.1, 184.1, 391, 397, 410, 284.1, 440.24, 352, 353, 217.5, 423.39

[56] References Cited

U.S. PATENT DOCUMENTS

| | | | |
|---|---|---|---|
| 3,420,572 | 1/1969 | Bisland | 297/410 X |
| 3,554,599 | 1/1971 | Pietschmann | 297/353 |
| 3,885,259 | 5/1975 | Cheong | 297/180.1 X |
| 4,718,724 | 1/1988 | Quinton et al. | 297/230.14 X |
| 4,862,536 | 9/1989 | Pruit | 297/230.14 X |
| 4,930,838 | 6/1990 | Brabant | 297/184.1 X |
| 5,100,200 | 3/1992 | Keusch et al. | 297/353 X |
| 5,112,106 | 5/1992 | Asbjornsen et al. | 297/410 X |

FOREIGN PATENT DOCUMENTS

| | | | |
|---|---|---|---|
| 93/01951 | 2/1993 | WIPO | 297/217.4 |

*Primary Examiner*—Milton Nelson, Jr.

*Attorney, Agent, or Firm*—Morton J. Rosenberg; David I. Klein; Jun Y. Lee

[57] ABSTRACT

A cushioning device that can be arranged on a chair or other types of seat backs to provide better comfort to the user when resting is provided, and includes a head rest plate, a back rest plate, a waist rest plate, a base plate and a leg rest plate. The head rest plate and the waist rest plate are respectively provided with a cushioning pad which may be curved to a suitable extent to support the head and waist of the user to enhance the user's comfort. The head rest plate can be pushed into the back rest plate which is comprised of an upper back rest portion and a lower back rest portion. The back rest plate in turn can be slid into the waist rest plate, they are then fitted into a recess of a joining element and connected to the leg rest plate to form a rectangular structure convenient for carrying and storage.

6 Claims, 8 Drawing Sheets

CUSHIONING DEVICE

BACKGROUND OF THE INVENTION

1. Field of the Invention

The present invention relates generally to a cushioning device, and more particularly to a cushioning device which may be arranged on an office chair or other type of seat backs to provide support in the waist area to promote comfort and which is collapsible to facilitate carrying and storage.

2. Prior Art

The backs of conventional office chairs, or other types of seats, are usually not higher than the shoulders of ordinary people. When the user wants to sit back and rest, the user cannot rest comfortably and has to slide downwardly a small amount due to the design of conventional chairs. After some time, the user may have a backache and neckache. Therefore, the user may choose to rest against the desk by laying heir head on their arms crossed on the desk. But, such a posture may cause poor circulation of blood in the hands and legs. Although there are available air cushions so that a user may rest their head on the air cushion disposed on a desk, the problem of numb hands and sore neck cannot be prevented.

SUMMARY OF THE INVENTION

Accordingly, the primary object of the present invention is to provide a cushioning device which may be directly arranged on a conventional chair to provide support for the head, the back and the waist of the user when the user is resting in the chair so that the user can rest comfortably.

Another object of the present invention is to provide a cushioning device having a length which may be adjusted to adapt well to different users.

A further object of the present invention is to provide a cushioning device comprising a head rest plate that may be pushed into or pulled out from a back rest plate, that in turn may also be pushed into or pulled out from between a waist rest plate and a base plate, so that the cushioning device may be closed or extended with ease and may be carried or stored conveniently,

DETAILED DESCRIPTION OF THE PREFERRED EMBODIMENT

Figure 1:
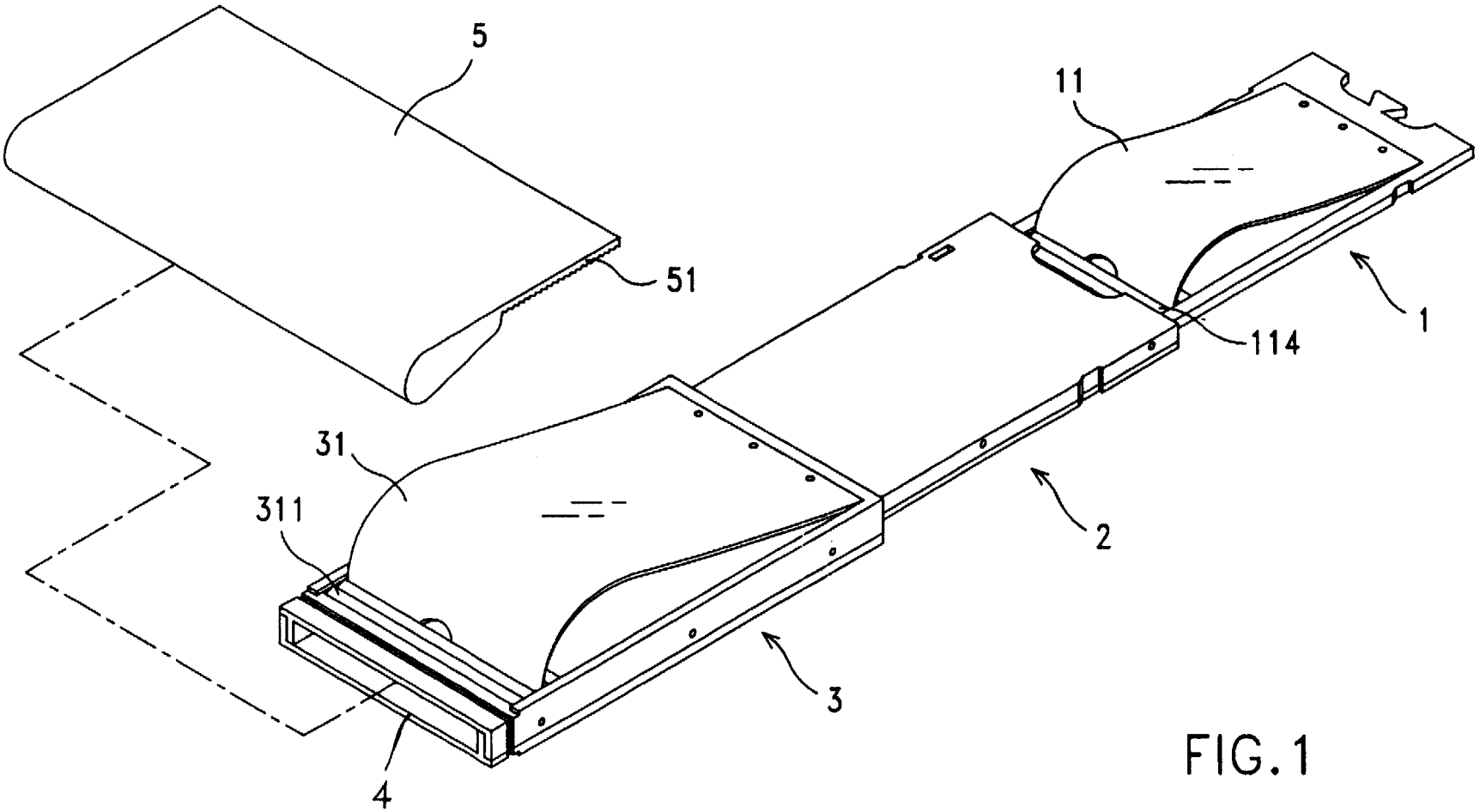
FIG. 1 is an elevational view of a preferred embodiment of the present invention.

With reference to FIG. 1, a preferred embodiment of the present invention is shown. The cushioning device according to the present invention may be placed on a chair or other types of seat backs to increase the comfort when the user sits back and rests against the chair. The cushioning device essentially comprises a head rest plate 1, a back rest plate 2, a waist rest plate 3, a base plate 4, and a leg rest plate 5. The head rest plate 1 is installed inside the back rest plate 2. A resilient head cushioning pad 11 is fixedly provided at an upper side of the head rest plate 1. One end of the head cushioning pad 11 may be placed in one of a plurality of grooves 114 of the head rest plate 1 so that it may have a curved shape for supporting the head of the user. The back rest plate 2 is installed inside the waist rest plate 3. Art upper side of the waist rest plate 3 is provided with a resilient waist cushioning pad 31 in the shape of a planar plate one end of the waist cushioning pad 31 may he placed in one of a plurality of grooves 311 so that it may have a curved shape to support the waist of the user. Additionally, there is provided a joining member 12 (referring to FIG. 4). The waist rest plate 3 my be inserted into a recess 13 of the joining member 12. The leg rest portion S is provided with a plurality of non-skid strips 51 on its lower surface.

Figure 2:
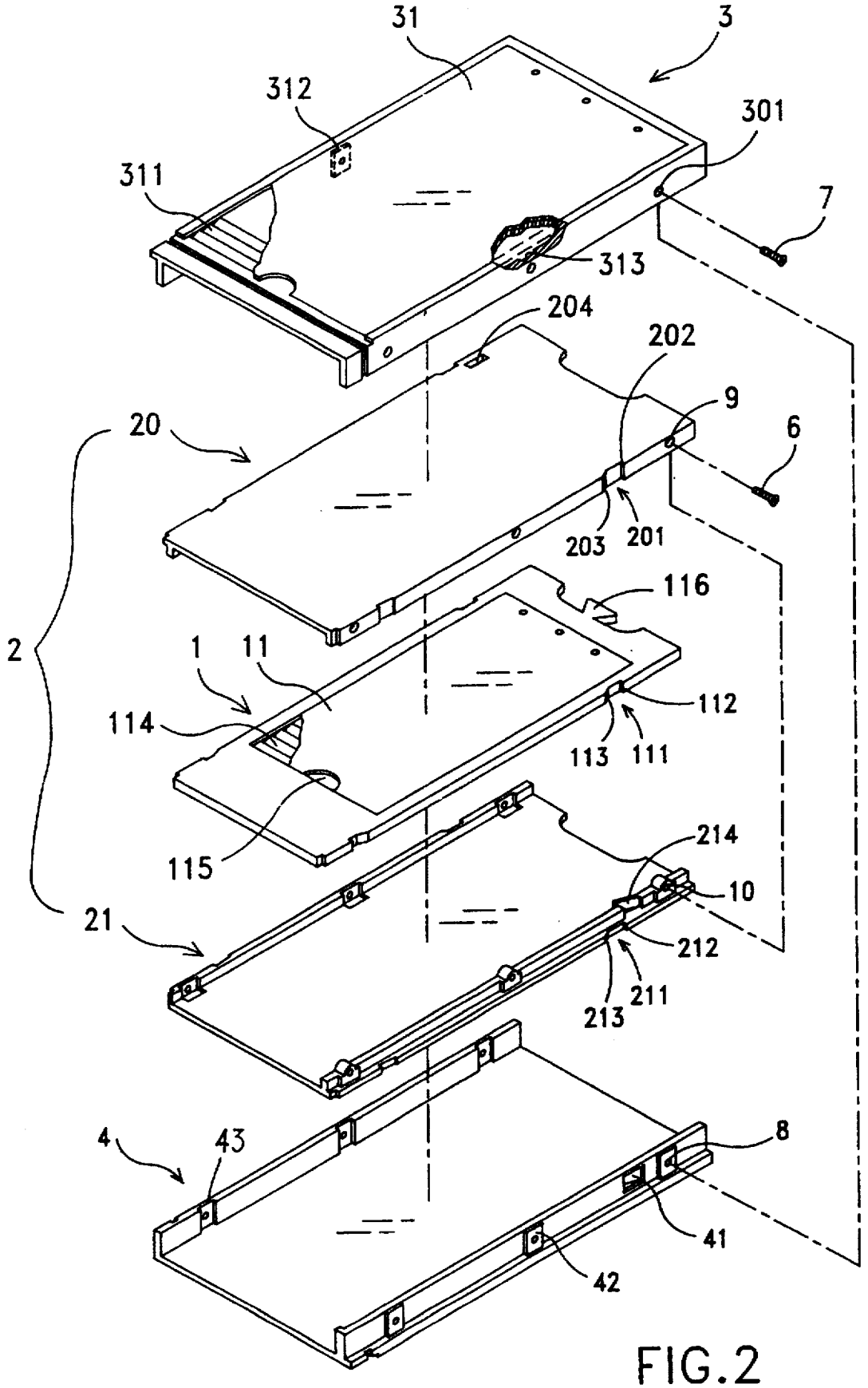
FIG. 2 is an elevational exploded view of the preferred embodiment of the present invention.
Figure 3:
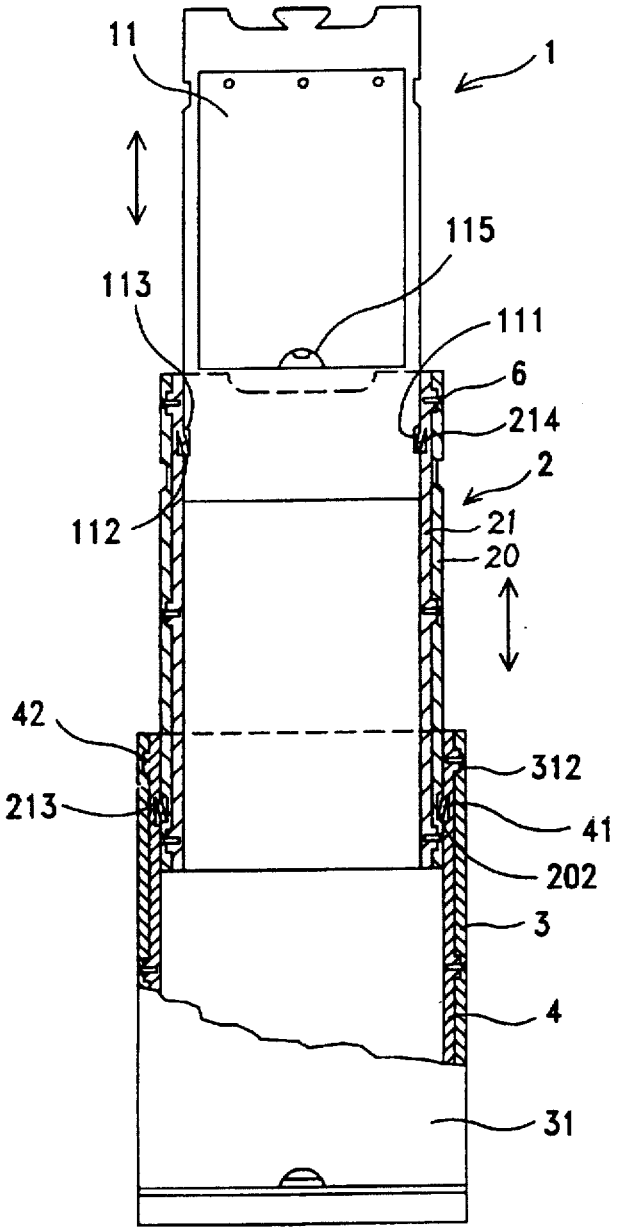
FIG. 3 is a view of the present invention, partially sectioned, when it is pulled out.
Figure 4:
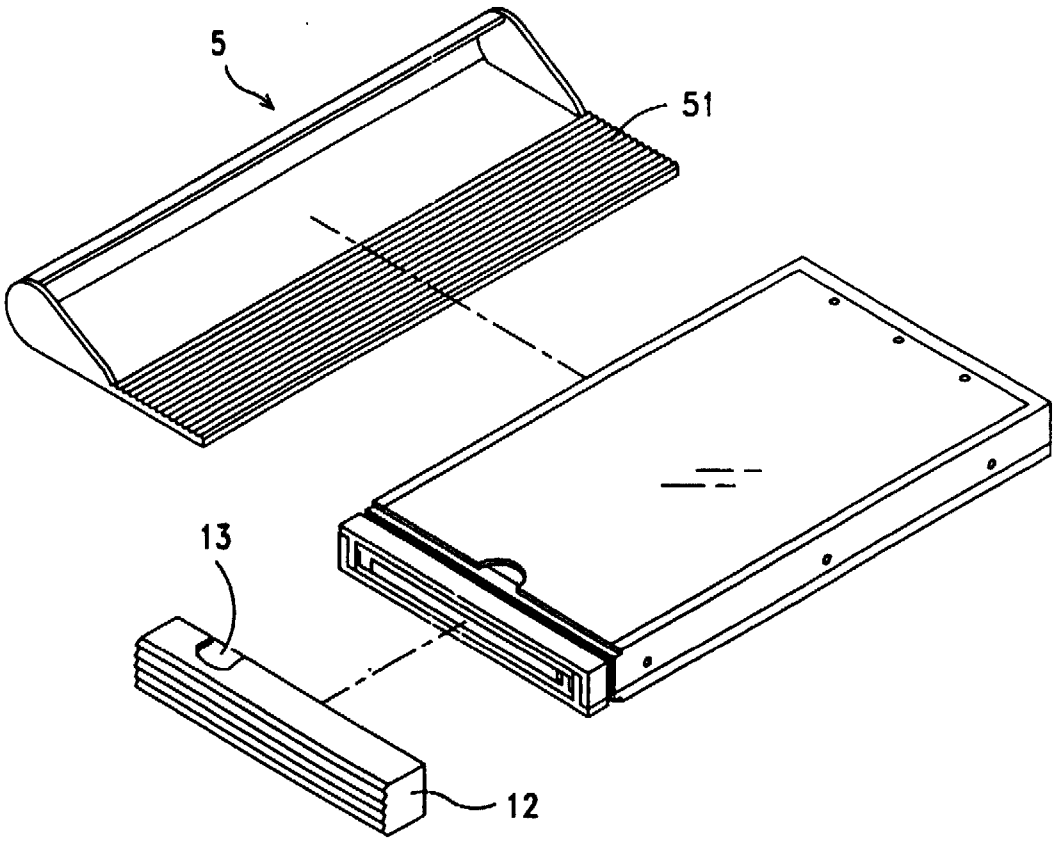
FIG. 4 is a perspective view illustrating the closing of the present invention.

Referring to FIGS. 2, 3 and 4, the back rest plate 2 is comprised of an upper back rest portion 20 and a lower back rest portion 21, and the head rest plate i is installed between the upper and lower back rest portions 20 and 21. A plurality of screw 6 respectively pass through a plurality of holes 9 of the upper back rest portion 20 to be engaged in a plurality of holes 10 of the lower back rest portion 21. The head rest plate 1 is connected to the head cushioning pad 11 and a pull-out portion 116. The head cushioning pad 11 has a notch 115 to facilitate the user's application of force. The user may hold the notch 115 and place one end of the head cushioning pad 11 into one of the grooves 114 so that the head cushioning pad 11 takes on a curved contour. The two lateral sides of the head rest plate i are each provided with at least one recess 111. The recess 111 includes a right-angled portion 112 and an oblique portion 113. The two lateral sides of the upper back rest portion 20 are each provided with at least one recess 201, and an elongated slot 204 is further provided on the upper back rest portion 20. The recess 201 of the upper back rest portion 20 includes a right-angled portion 202 and an oblique portion 203. When the head rest plate 1, installed inside the back rest plate 2, is slid outwardly along the inside of the lower back rest portion 21 (see FIG. 3), the recess 111 of the head rest plate 1 will slide until the head rest plate 1 is blocked by a resilient stop hook 214 located at an inner side of the lower back rest portion 21. By means of this arrangement, the stop hook 214 may engage the right-angled portion 112 of the recess 111 of the head rest plate 1 to position the head rest plate 1. When it is desired to push the head rest plate i back into the back rest plate 2, due to the oblique portion 113 of the recess 111, the head rest plate 1 may be pushed so that the recess 111 disengages easily from the retention of the stop hook 214 and the head rest plate 1 may be pushed back into the lower back rest portion 21 of the back rest plate 2.

As mentioned above, the upper back rest portion 20 and the lower back rest portion 21 are locked together by means of screws 6 passing through the respective holes 9 and holes 10. The back rest plate 2 is mounted inside a base plate 4. The lower back rest portion 21 is also provided with at least one recess 211 at each lateral side, respectively. After the upper and lower back rest portions 20 and 21 are assembled, the respective recesses 201 and 211 form joint recesses. When the back rest plate 2 is to be slid out from the base plate 4, a resilient stop hook 41 at one side of the base plate 4 may engage a right-angled portion 212 of the recess 211 of the lower back rest portion 21 and the right-angled portion 202 of the recess 201 of the upper back rest portion 20 so that the back rest plate 2 my be positioned relative to the base plate 4. On the other hand, the oblique portion 203 of the recess 201 of the upper back rest portion 20 and an oblique portion 213 of the recess 211 of the lower back rest portion 21 may be easily slid past the stop hook 41 of the base plate 4 to allow the back rest plate 2 to be pushed back into the base plate 4.

The waist rest plate 3 is provided with at least one stop block 312 for fitting into at least one retaining recess 43 of the base plate 4, and at least one retaining recess 313 for receiving at least one stop block 42 of the base plate 4. After the waist rest plate 3 and the base plate 4 are assembled into a rectangular structure, they are inserted into the recess 13 of the joining member 12 and the leg rest plate 5 is connected thereto.

In summary, the head rest plate 1 is disposed inside the back rest plate 2 which is installed inside the waist rest plate 3. A plurality of locking screws 7 are used to pass through a plurality of holes 301 of the waist rest plate 3 and the holes 8 of the stop block 42 of the base plate 4 to secure the waist rest plate 3 and the base plate 4 together, which are then inserted into the recess 13 of the joining member 12 and connected to the leg rest plate 5 to form a portable cushioning device. The head cushioning pad 11 is provided for supporting the head of the user. The waist cushioning pad 31 has one end inserted into one of the grooves 311 so that it may be curved to a shape most comfortable to the user. The cushioning device of the invention may be extended to form a long cushioning pad which may be arranged on a chair (see FIG. 5) so that the user may comfortably rest against the chair. The length of the present invention may be adjusted to suit users of various heights. Besides, the present invention is collapsible (see FIGS. 3 and 4) to save space for carrying and storage.

Figure 5:
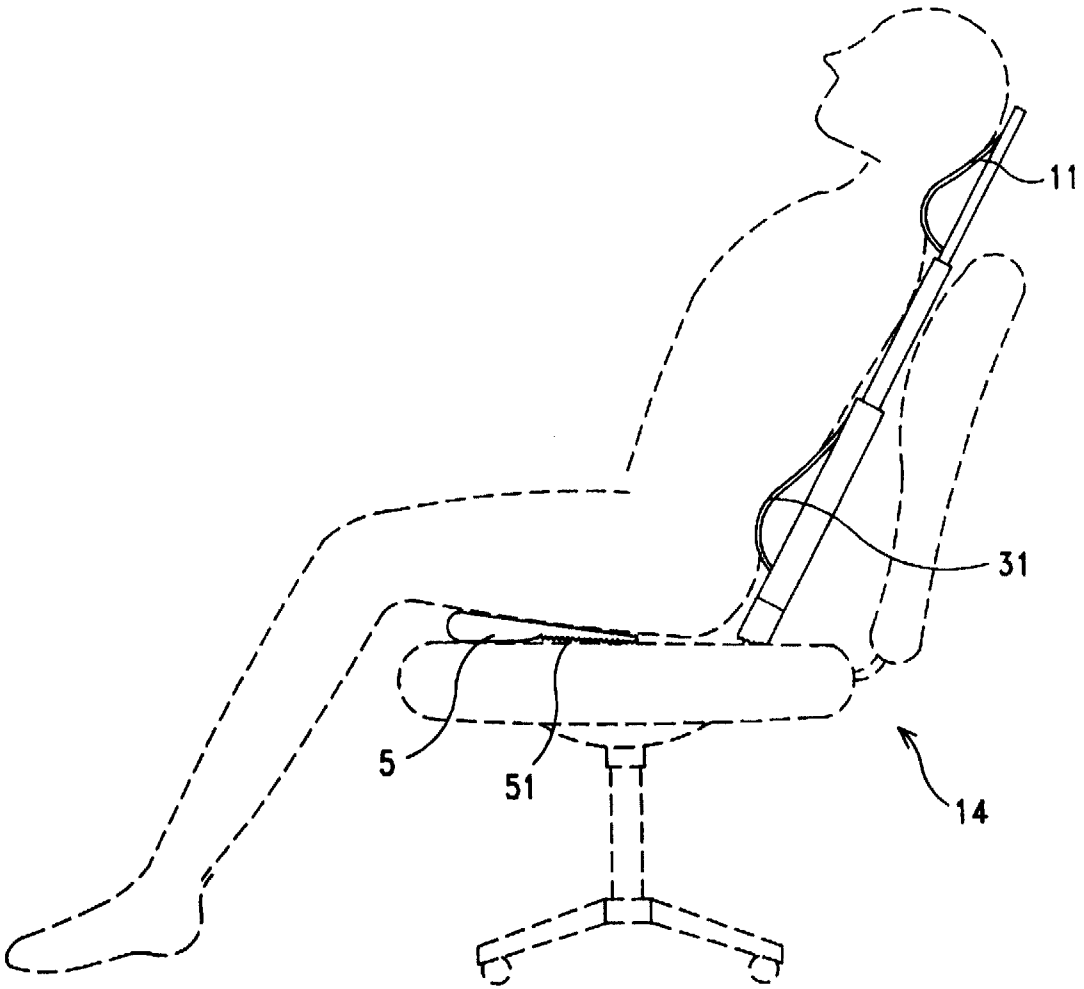
FIG. 5 is a schematic view illustrating the preferred embodiment of the present invention in use.

With reference to FIG. 5, in use, the leg rest plate 5 which may be configured to be substantially triangular in shape may be placed below the thighs of the user to enhance comfort. The lower surface of the leg rest plate 5 has non-skid strips 51 to prevent the leg rest plate 5 from slipping off the chair 14.

Figure 6:
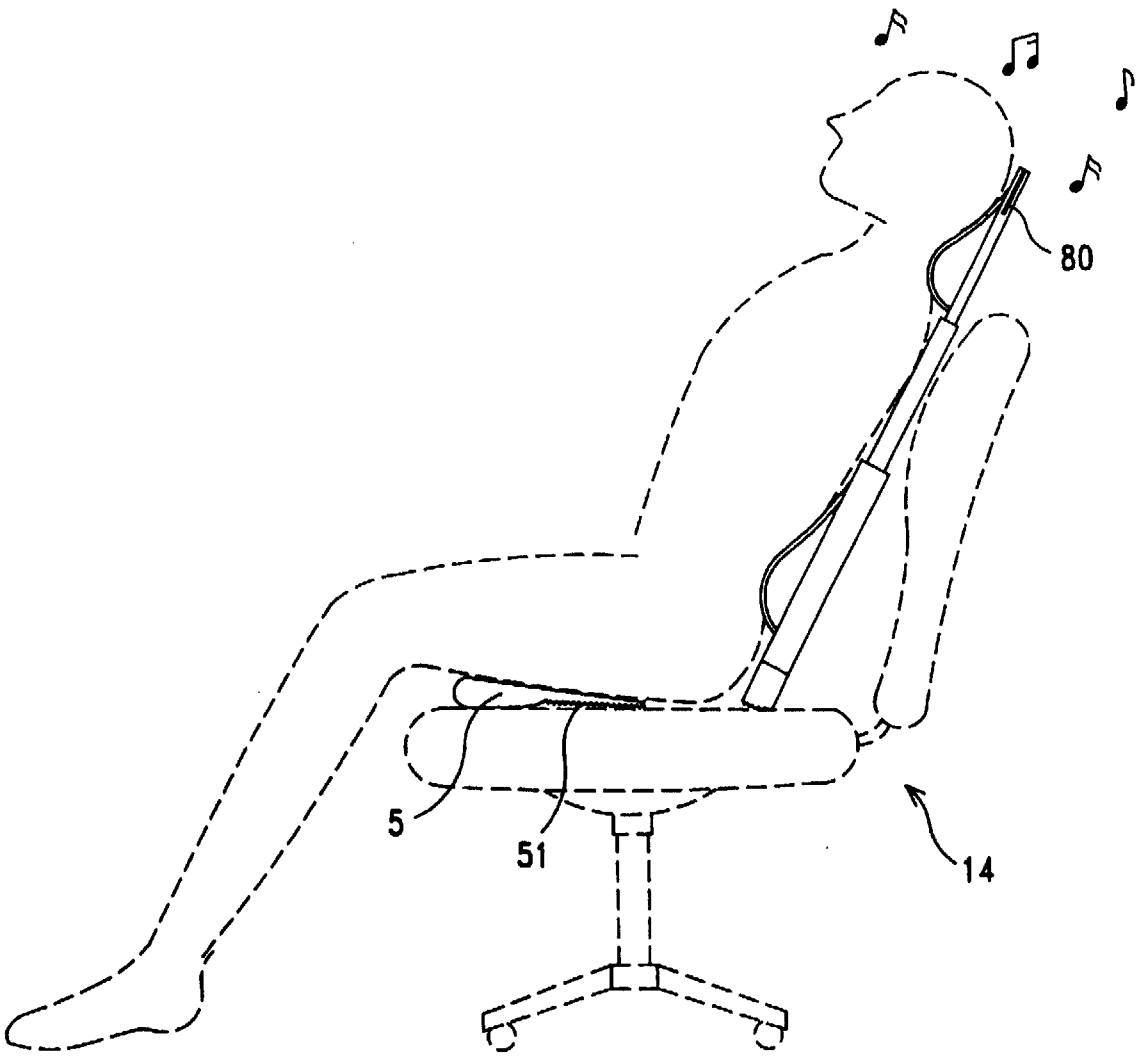
FIG. 6 is a schematic view illustrating a further preferred embodiment of the present invention.

FIG. 6 shows another preferred embodiment of the present invention. An audio device and speaker 80 may be installed in the head rest plate 1 to provide music when the user rests.

Figure 7:
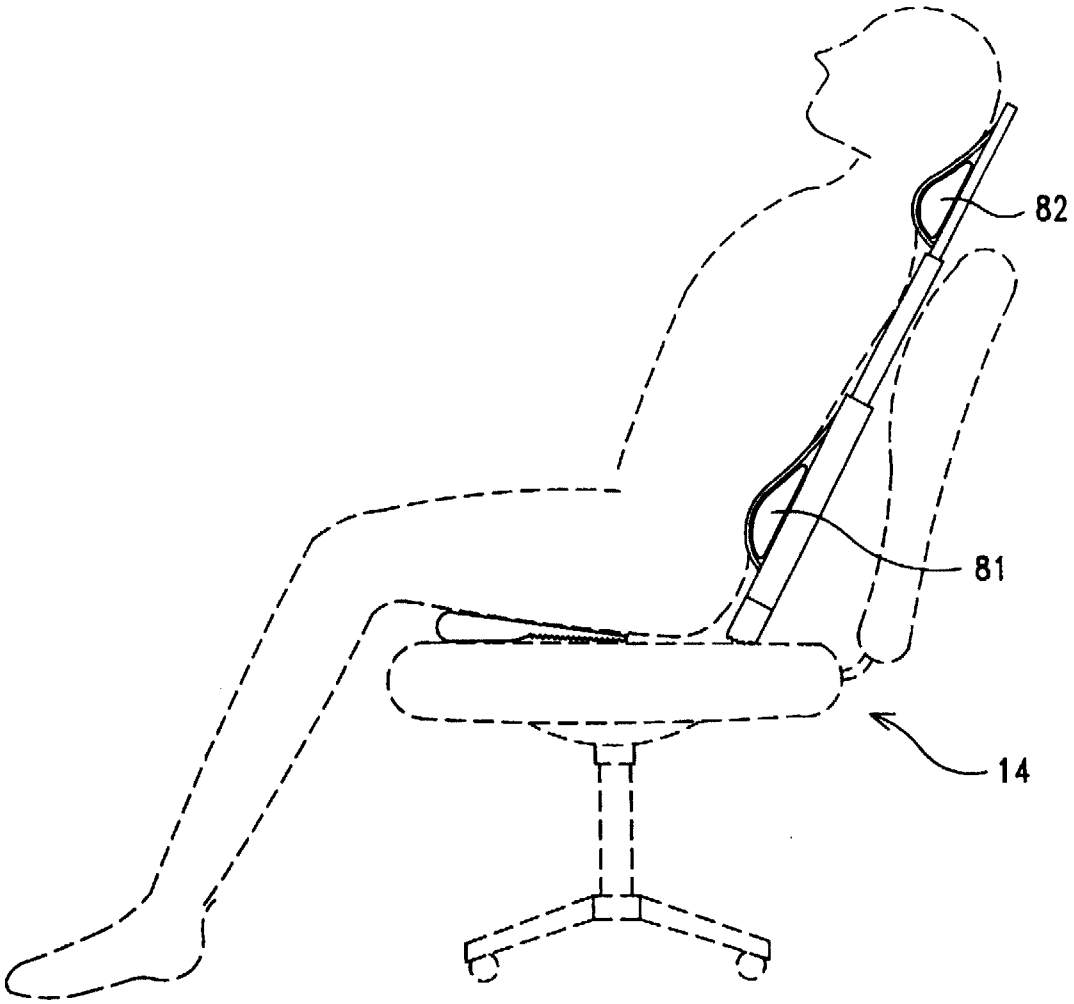
FIG. 7 is a schematic view illustrating still another preferred embodiment of the present invention.

FIG. 7 shows a further preferred embodiment. When the head cushioning pad 11 is bent into a suitable curved shape, defining a space between the grooves 114 and the head cushioning pad 11, a cooling or warming cushion means 82 may be disposed in the curved space thus formed. When the waist cushioning pad 31 is curved to define a space between one of the grooves 311 and the waist cushioning pad 31, a cooling or warming cushion means 81 may be disposed in the curved space thus formed.

Figure 8:
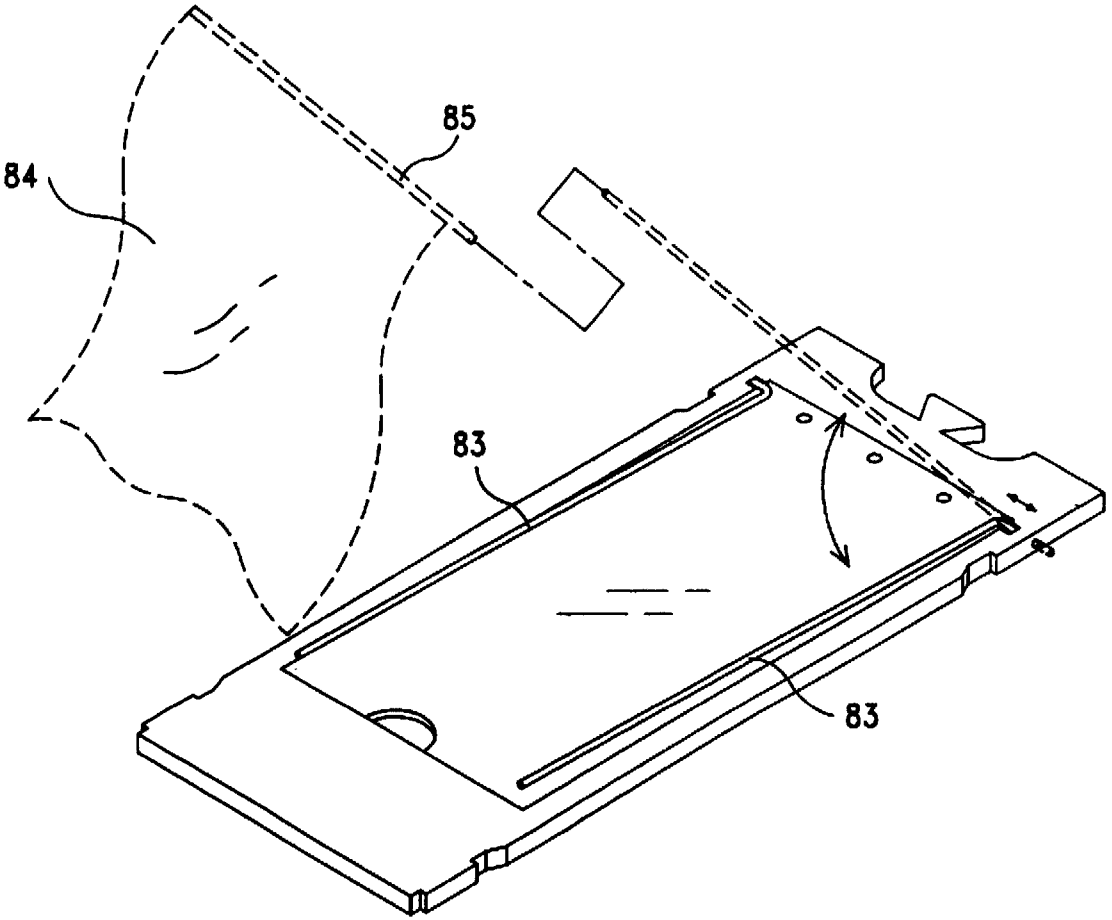
FIG. 8 is a schematic view illustrating a still further preferred embodiment of the present invention.

With reference to FIG. 8, which shows still another preferred embodiment of the present invention, rods 83 may be provided in the head rest plate 1 for coupling with rod 85 of face cover 84 to prevent light from reaching the user's eyes when resting.

Although the present invention has been illustrated and described with reference to the preferred embodiment thereof, it should be understood that it is in no way limited to the details of such embodiment but is capable of numerous modifications within the scope of the appended claims.

What is claimed is:

1. A cushioning device, comprising:

a head rest plate connected to a resilient head cushioning pad disposed thereon, said head cushioning pad having a notch at one end, and said head rest plate having a plurality of grooves formed thereon, and at least one recess being respectively disposed on two lateral sides of said head rest plate;

a back rest plate including an upper back rest portion and a lower back rest portion, at least one recess being disposed respectively on two lateral sides of said upper back rest portion and said lower back rest portion, ad a resilient stop hook being disposed at an inner side of said lower back rest portion;

a base plate having two lateral sides each of which is provided with a plurality of stop blocks and retaining recesses, and a resilient stop hook being disposed at one side thereof;

a waist rest plate connected to a waist cushioning pad disposed thereon, said waist cushioning pad having a notch at one end, and said waist rest plate having a plurality of grooves formed thereon, and at least one recess and stop block being respectively disposed on two lateral sides of said waist rest plate;

a joining member having a recess; and a leg rest plate having a plurality of non-skid strips formed in a lower side thereof, wherein said head rest plate can be pushed into said back rest plate, and said back rest plate can be pushed between said waist rest plate and said base plate, which are then inserted into said recess of said joining member before connecting to said leg rest plate to form a rectangular structure for carrying and storage.

2. A cushioning device as claimed in claim 1, wherein said head rest plate is provided with a pull-out portion to facilitate pulling.

3. A cushioning device as claimed in claim 1 further comprising a speaker and audio means disposed in said heat rest plate to generate music.

4. A cushioning device as claimed in claim 1 further comprising a cooling or warming cushion means disposed between said head rest plate and said head cushioning pad when said head cushioning pad is disposed in a curved contour by said notched end of said head cushioning pad being inserted into one of said grooves of said head rest plate.

5. A cushioning device as claimed in claim 1 further comprising a cooling or warming cushion means being disposed between said waist rest plate and said waist cushioning pad when said waist cushioning pad is disposed in a curved contour by said notched end of said waist cushioning pad being inserted into one of said grooves of said waist rest plate.

6. A cushioning device as claimed in claim 1, wherein said head rest plate is further provided with a plurality of rod elements for coupling with a face cover for blocking light.

* * * * *